US007691231B2

(12) United States Patent
Ono et al.

(10) Patent No.: US 7,691,231 B2
(45) Date of Patent: Apr. 6, 2010

(54) NEWSPRINT PAPER TREATED WITH CATIONIC SURFACE SIZING AGENT

(75) Inventors: Hiroshi Ono, Tokyo (JP); Satoshi Ishioka, Tokyo (JP); Fuminari Nonomura, Tokyo (JP); Yasunori Nanri, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 789 days.

(21) Appl. No.: 10/563,621

(22) PCT Filed: Jun. 24, 2004

(86) PCT No.: PCT/JP2004/009288

§ 371 (c)(1),
(2), (4) Date: Apr. 17, 2006

(87) PCT Pub. No.: WO2005/003457

PCT Pub. Date: Jan. 13, 2005

(65) Prior Publication Data

US 2006/0225854 A1 Oct. 12, 2006

(30) Foreign Application Priority Data

Jul. 7, 2003 (JP) ..... 2003-192575

(51) Int. Cl.
*D21H 19/20* (2006.01)
*D21H 21/16* (2006.01)

(52) U.S. Cl. ..... 162/135; 162/158; 162/164.1; 162/164.3; 162/168.2; 162/181.3; 428/341; 428/342

(58) Field of Classification Search ..... 162/135, 162/158, 164.1, 164.3, 164.6, 168.1–168.3, 162/169, 177, 179, 137, 175, 181.1–181.3; 428/340–342, 478.8, 479.3, 479.6, 507, 510
See application file for complete search history.

(56) References Cited

U.S. PATENT DOCUMENTS

| | | | | |
|---|---|---|---|---|
| 5,308,441 | A * | 5/1994 | Kern | 162/158 |
| 5,750,253 | A * | 5/1998 | Satake et al. | 428/342 |
| 6,310,132 | B1 * | 10/2001 | Sackmann et al. | 524/457 |
| 6,413,370 | B1 * | 7/2002 | Wurster et al. | 162/135 |
| 7,270,727 | B2 * | 9/2007 | Varnell | 162/164.6 |
| 7,311,801 | B2 * | 12/2007 | Ono et al. | 162/135 |
| 2003/0106659 | A1 * | 6/2003 | Malmstrom et al. | 162/158 |
| 2004/0177938 | A1 * | 9/2004 | Ono et al. | 162/135 |
| 2004/0200593 | A1 * | 10/2004 | Koskinen et al. | 162/205 |
| 2004/0226675 | A1 * | 11/2004 | Malmstrom et al. | 162/158 |
| 2004/0261963 | A1 * | 12/2004 | Suzuki et al. | 162/135 |
| 2005/0022956 | A1 * | 2/2005 | Rodriguez et al. | 162/135 |
| 2005/0176908 | A1 * | 8/2005 | Ono et al. | 526/317.1 |
| 2006/0191653 | A1 * | 8/2006 | Wiese et al. | 162/135 |
| 2006/0225854 | A1 * | 10/2006 | Ono et al. | 162/135 |
| 2006/0257635 | A1 * | 11/2006 | Nonomura et al. | 428/211.1 |
| 2007/0240838 | A1 * | 10/2007 | Koyamoto et al. | 162/134 |
| 2008/0017337 | A1 * | 1/2008 | Duggirala et al. | 162/70 |
| 2008/0023163 | A1 * | 1/2008 | Ishioka et al. | 162/164.2 |
| 2009/0068485 | A1 * | 3/2009 | Inaoka et al. | 428/481 |

FOREIGN PATENT DOCUMENTS

| | | |
|---|---|---|
| JP | 57-56598 | 4/1982 |
| JP | 06-240598 | 8/1994 |
| JP | 08-232193 | 9/1996 |
| JP | 09-013298 | 1/1997 |
| JP | 09-111691 | 4/1997 |
| JP | 10-259591 | 9/1998 |
| JP | 11-021790 | 1/1999 |
| JP | 11-050393 | 2/1999 |
| JP | 11-107190 | 4/1999 |
| JP | 11-140791 | 5/1999 |
| JP | 11-158795 | 6/1999 |
| JP | 11-323774 | 11/1999 |
| JP | 2000-017597 | 1/2000 |
| JP | 2000-064193 | 2/2000 |
| JP | 2002-173894 | 6/2002 |
| JP | 2002-294588 | 10/2002 |
| WO | WO 2004085742 A1 * | 10/2004 |
| WO | WO 2005003457 A1 * | 1/2005 |
| WO | WO 2006003832 A1 * | 1/2006 |

OTHER PUBLICATIONS

Machine Translation of JP-2000-064193, published on Feb. 29, 2000.*
Machine Translation of JP-06-240598, published on Aug. 30, 1994.*
Machine Translation of JP-09-013298, published on Jan. 14, 1997.*
Machine Translation of JP-11-323774, published on Nov. 26, 1999.*
Irene Bruckle, "The Role of Alum in Historical Papermaking," Sep. 1993, Abbey Newsletter, vol. 1993, pp. 1-16.*

* cited by examiner

*Primary Examiner*—José A Fortuna
(74) *Attorney, Agent, or Firm*—Knobbe Martens Olson & Bear, LLP

(57) ABSTRACT

Newsprint for offset printing having sufficient water absorption resistance to provide a clear printing image with less color registration problems upon offset printing is manufactured by coating base paper, to which aluminum sulfate (a 50% by weight $Al_2O_3.14H_2O$ product) is added at a ratio of less than 3.0% by weight upon paper making, with a surface treating agent mainly comprised of (A) a water-soluble macromolecular substance selected from starches, PVAs, polyacrylamides, and cellulose derivatives, (B) a copolymer obtained by the copolymerization of a styrene monomer and a cationic monomer, a water-soluble copolymer obtained by the copolymerization of a styrene monomer, a cat ionic monomer and a hydrophobic monomer, or a water-soluble copolymer obtained by treating one of these copolymers in which a tertiary amine-containing vinyl monomer is used as a cationic monomer, with a quaternizing agent.

11 Claims, No Drawings

NEWSPRINT PAPER TREATED WITH CATIONIC SURFACE SIZING AGENT

This application is the U.S. National Phase under 35 U.S.C. §371 of International Application PCT/JP2004/009288, filed Jun. 24, 2004, which claims priority to Japanese Patent Application No. 2003-192575, filed Jul. 7, 2003. The International Application was not published under PCT Article 21(2) in English.

FIELD OF THE INVENTION

The present invention relates to newsprint, particularly newsprint for offset printing, with improved water absorption resistance.

BACKGROUND OF THE ART

Recently, printing technology has been remarkably improved through the introduction of offset printing, color printing, high-speed, large-scale printing, automation, and the like. With such progress, improvement in various physical properties of printing paper is demanded from the viewpoints of workability and printing adaptability.

Newsprint is mainly composed of mechanical pulp (referred to as MP hereinafter) and deinked pulp (referred to as DIP hereinafter) and classified into medium-grade paper or low-grade paper. However, the quality requirements for newsprint are stricter than those for general printing paper because in newspaper printing a specified large number of newspapers have to be securely printed within a specified duration of time in a specified time zone. Since a reduction in weight and an increase in the DIP ratio are required for current newsprint, improvement in various respects has to be made considering these and other requirements. Thus, the improvement of newsprint requires a much higher level of technology as compared to that of general printing paper.

As regards to the newspaper printing system, transition to offset printing has proceeded rapidly together with the introduction of computer systems so that today the offset printing system is predominantly used. Further, as offset color printers such as satellite-type and tower-press-type printers have come into wide use, color printing space in newspaper increasingly tends to be expanded. Due to the use of currently popularized four color offset printing, in which the amount of adhering dumping water increases about four times and the transfer of the dumping water causes swelling of newsprint, a pitch problem (dot gaps) is generated, resulting in possible color registration errors with poor image resolution on the printed surface.

Due to the increased popularity of offset printing, quality requirements for newsprint today are different from those for relief printing newsprint; for example the following qualities are required:

(1) paper should have wet strength and not suffer from water break;

(2) paper should retain adequate water absorption resistance;

(3) paper should have a small peeling strength (Neppari); and (4) paper powder should not be generated.

Among these quality requirements, provision of water absorption resistance (in other words, provision of sizing property) is an important objective.

Further, in addition to the use of offset printing system, a lesser use of GP due to an increase in DIP content, popularization of neutral papermaking, reduction in the basis weight of newsprint and the like are also considered as factors tending to cause the swelling of fibers and generate color registration errors.

In response to the quality requirements for newsprint paper, such as a higher whiteness level and improved clearness in color printing, so-called neutral papermaking has recently become a major trend, in which base paper for newsprint is manufactured at a pH in the range from neutral to weak alkaline. Due to this transition to neutral papermaking, the addition ratio of aluminum sulfate in newsprint production is reduced so that the effect (provision of water absorption resistance) of a surface sizing agent conventionally used in newsprint base paper produced in acidic papermaking (hereinafter referred to as acidic newsprint base paper) tends to be reduced. The surface sizing agent used for acidic newsprint paper is generally a copolymer of a monomer containing a carboxyl group and a styrene monomer. It is presumed that the interaction between the carboxyl group in the molecule of this surface sizing agent and an aluminum component in base paper for newsprint aligns the molecule of the surface sizing agent so that the hydrophobic monomer part having the carboxyl group is positioned inside the paper and the hydrophobic styrene monomer part is positioned on the surface of the paper, thereby providing water absorption resistance to the newsprint. However, also in base paper for newsprint having a low aluminum sulfate addition ratio, particularly in base paper for newsprint produced by a neutral papermaking process (hereinafter referred to as neutral newsprint base paper), the abovementioned alignment of the surface sizing agent is not as complete as in acidic newsprint base paper, which results in a huge decrease in water absorption resistance when compared to the case where the same amount of the abovementioned surface sizing agent is used for coating.

As mentioned above, it has been difficult to provide water absorption resistance to neutral newsprint at the same level as to acidic newsprint using surface sizing agents conventionally used for acidic newsprint. Further, in acidic newsprint, further improvement of water absorption resistance is desired.

Water absorption resistance has been conventionally controlled in the same manner as in general printing paper by adding sizing agents inside the paper (internal addition sizing) or by adding the agents outside the paper (external addition sizing). The internal addition is a means of adding an agent to pulp slurry at a so-called wet-end and make the agent to be contained in the inside of paper simultaneously at the time of papermaking. The external addition is a means of coating an agent onto the surface of base paper using a coating machine such as a two-roll size press and a gate roll coater after papermaking.

Examples of generally used sizing agents for internal addition include fortified rosin sizing agents, emulsion-type sizing agents, and synthetic sizing agents for acidic papermaking; and alkyl ketene dimers (AKDs) and alkenyl succinic anhydrides (ASAs) for neutral papermaking. Various problems are caused by using internal addition of such sizing agents, as follows:

(1) an agent should be added to pulp slurry at a low concentration;

(2) the amount of an agent fixed on pulp sheet is not constant (the amount of the agent fixed is low);

(3) manufacturing of paper that does not require water absorption resistance cannot be performed simultaneously when multiple numbers of papermaking machines are sharing the same circulatory white water;

(4) the effect of a retention aid is unstable; when the retention is increased, colored foreign materials derived from DIP are also integrated into the sheet;

(5) water absorption resistance changes with time;

(6) the retention of an internal addition sizing agent tends to decrease when a high-speed papermaking machine is used for manufacturing neutral and/or light-weighted newsprint, which makes it difficult to provide water absorption resistance, and (7) the retention of an internal addition sizing agent tends to decrease when newsprint containing DIP at 80% or more is manufactured using a high-speed papermaking machine at 1,000 m or more/minute; this makes it difficult to provide water absorption resistance.

Accordingly, when a means of internal addition of a sizing agent is applied, the control of the amount of the sizing agent to add is difficult and the amounts of the internal addition sizing agent and retention aid have to be increased or decreased depending on the circumstances. The internal addition sizing agent is added in an excessive amount when its effect is insufficient, which tends to cause a decrease in paper strength, generation of marked stains in white water system caused by adhesion and accumulation of a hydrophobic sizing agent and the like, resulting in problems in cost, quality and operation conditions.

A papermaking machine for manufacturing newsprint generally is equipped with a gate roll coater for coating an agent onto the surface of newsprint base paper. In the abovementioned conventional technology for providing water absorption resistance to newsprint, a styrene surface sizing agent, which is a copolymer of a monomer containing a carboxyl group and a styrene monomer, is generally used for acidic newsprint as mentioned above. However, sufficient water absorption resistance cannot be attained when this styrene surface sizing agent is used for coating neutral newsprint added with a small ratio of aluminum sulfate, in particular neutral base newsprint.

The present inventors have been continuously studying on the provision of water absorption resistance to newsprint by external addition of sizing agents and have already made patent applications as follows. There is described a method of forming a coating layer containing a composition to control water absorptivity mainly composed of component A, component B and component C on base paper for printing (particularly newsprint). Component A: modified starch or starch; component B: at least one polyacrylamide selected from nonionic polyacrylamides, cationic polyacrylamides having a tertiary amine group, cationic polyacrylamides having a quaternary ammonium group, and amphoteric polyacrylamides; and component C: an anionic copolymer of a monomer having a weight average molecular weight of 1,000 to 3,000,000 and a hydrophobic substituent having 6 to 10 carbon atoms and a monomer having a carboxyl group or a sulfonic acid group (see Japanese Patent No. 2939971). There is described a method of manufacturing a neutral newsprint, in which a ketene dimer sizing agent and a paper surface treating agent are externally added using a gate role coater to neutral newsprint in which calcium carbonate is used as a filler, after which the coated paper is passed through a soft calender at a surface temperature of 50° C. or higher to attain the sizing degree (see Japanese Patent No. 2980833). There is described a method in which a coating layer containing an absorptivity controlling composition mainly comprised of two components, component A and component B, is formed on base paper for printing (particularly newsprint base paper) to achieve a droplet water absorption degree of 10 to 1,000 seconds. Component A: at least one polyacrylamide selected from nonionic polyacrylamides, cationic polyacrylamides, and amphoteric polyacrylamides; and component B: an anionic copolymer of a monomer having a hydrophobic substituent and a monomer having a carboxyl group and/or a sulfonic acid group (see Japanese Patent No. 3093965). There is described a method in which a coating layer containing a surface sizing agent mainly comprising three components consisting of the following component A, component B, and component C, or two components mainly comprising component B and component C at a ratio by solid weight of each component of A:B:C=0-80:95-20:1-10 is formed on newsprint base paper. Component A: at least one polyacrylamide selected from nonionic polyacrylamides, cationic polyacrylamides, and amphoteric polyacrylamides; component B: an anionic ammonium salt of a copolymer of a monomer having a hydrophobic substituent and a monomer having a carboxyl group, and component C: at least one resin acid selected from dehydroabietic acid, abietic acid, dihydroabietic acid, pimaric acid, neopimaric acid, isopimaric acid, levopimaric acid, and palustrine, or rosin containing these resin acids (see Japanese Patent No. 3303291).

Surface sizing agents shown in the abovementioned conventional methods and sizing agents to be used in the present invention can be common in terms of providing water absorption resistance; however, a surface sizing agent to be used in the present invention is novel and has a different composition.

Further, in order to prevent accumulation of paper powder on a blanket and the resulting faint printing problem in offset printing in which printing ink having a relatively strong tackiness is used, there are prior technologies with an objective to increase the surface strength and water resistance of newsprint, as described below.

There are disclosed newsprint for offset printing in which base paper is coated with an aqueous solution containing a surface treating agent and dried, characterized in that said surface treating agent comprises at least a polyacrylamide polymer and an epoxy water-resistant agent and/or a polyvalent metal compound water-resistant agent (see Japanese Patent Application Laid-open No. Hei 10-259592); newsprint for offset printing in which base paper containing an internally added filler is coated with a surface treating agent, characterized in that said surface treating agent contains a polyvinyl alcohol copolymer having a silanol group (see Japanese Patent Application Laid-open No. Hei 11-21790); newsprint for offset printing in which base paper is coated with a surface treating agent and dried, characterized in that said surface sizing agent mainly comprises a synthetic resin latex having a gel content of 90% or more by weight (see patent Japanese Patent Application Laid-open No. Hei 11-50393); newsprint for offset printing in which base paper is coated with a surface treating agent and dried, characterized in that said surface treating agent mainly comprises a copolymer latex and contains a release agent (see Japanese Patent Application Laid-open No. Hei 11-158795); newsprint for offset printing in which both sides of base paper are coated with a surface treating agent and dried, characterized in that said surface treating agent mainly comprises an acrylic alkali swellable synthetic resin latex (see Japanese Patent Application Laid-open No. 2000-17597); newsprint for offset printing in which both sides of base paper are coated with a surface treating agent and dried, characterized in that said surface treating agent mainly comprises (a) starch or modified starch and (b) a hydrophobic acrylic surface sizing agent containing butyl (meth)acrylate and/or (meth)acryl 2-ethylhexyl as monomer components and having a glass transition temperature of 10° C. or lower, the ratio of said starch component to said hydrophobic acrylic surface sizing agent being in the range of 100:3 to 100:30 by solid weight (see Japanese Patent Application Laid-open No. 2002-294588).

[Patent reference 1] Japanese Patent No. 2939971

[Patent reference 2] Japanese Patent No. 2980833

[Patent reference 3] Japanese Patent No. 3093965

[Patent reference 4] Japanese Patent No. 3303291

[Patent reference 5] Japanese Patent Application Laid-open No. Hei 10-259591

[Patent reference 6] Japanese Patent Application Laid-open No. Hei 11-21790

[Patent reference 7] Japanese Patent Application Laid-open No. Hei 11-50393

[Patent reference 8] Japanese Patent Application Laid-open No. Hei 11-158795

[Patent reference 9] Japanese Patent Application Laid-open No. 2000-17597

[Patent reference 10] Japanese Patent Application Laid-open No. 2002-294588

DISCLOSURE OF THE INVENTION

An object of the present invention is to provide newsprint for offset printing which has sufficient water absorption resistance and exhibits decreased color registration errors showing clearly printed images, in particular to provide neutral newsprint for offset printing which has sufficient water absorption resistance.

Newsprint for offset printing is obtained by a process in which base paper for newsprint is coated with a surface treating agent mainly comprised of the following component (A) and component (B), dried and subjected to a calender treatment.

Component (A): at least one water-soluble macromolecular substance selected from the group consisting of starches, polyvinyl alcohols, polyacrylamides, and cellulose derivatives.

Component (B): a water-soluble surface sizing agent that is a copolymer obtained by the copolymerization of the following component (a) and component (b); a copolymer obtained by the copolymerization of component (a), component (b) and component (c); or a copolymer obtained by the quaternization of one of these copolymers in which a vinyl monomer containing a tertiary amine group is used as component (b), by component (d). Its cationization degree is preferably 1.3-3.0 meq/g, more preferably 1.3-2.5 meq/g, and most preferably 1.4-2.0 meq/g.

Component (a): Styrene Monomer

At least one styrene monomer selected from styrene, α-methyl styrene, chlorostyrene and cyanostyrene.

Component (b): Cationic Monomer

A vinyl monomer containing any one of primary amino group, secondary amino group, tertiary amino group, and quaternary ammonium group.

Component (c): Other Hydrophobic Monomers

At least one hydrophobic monomer which is copolymerizable and selected from methacrylic acid esters and acrylic acid esters.

Component (d): Quaternizing Agents

At least one quaternizing agent selected from epichlorohydrin, methyl chloride, ethyl chloride, benzyl chloride, dimethyl sulfate, diethyl sulfate, oxides, epoxy compounds, and organic halogen compounds.

BEST MODE TO CARRY OUT THE INVENTION

The present inventors found that the reason why it is difficult to provide water absorption resistance to newsprint, in particular to neutral newsprint, in which aluminum sulfate is added at a low ratio relative to pulp when papermaking, is because the cationic aluminum content in newsprint base paper is low and that water absorption resistance can be effectively provided to newsprint base paper by the external addition of a cationic surface sizing agent having a specific ionic strength, and thus completed the present invention.

The newsprint base paper to be used in the present invention can be either acidic newsprint base paper or neutral newsprint base paper; however, the effect of the provision of water absorption resistance can be greatly exerted when base paper in which aluminum sulfate (a 50% by weight $Al_2O_3.14H_2O$ product) is added at a ratio of less than 3.0% by weight relative to oven-dried pulp is coated with a surface treating agent containing a surface sizing agent of the present invention. In this regard, neutral newsprint base paper is particularly preferable. Further, the basis weight of base paper is not particularly limited and can be about 33-45 g/m$^2$.

A cationic surface sizing agent to be used in the present invention can be obtained by the copolymerization of a styrene monomer (component (a)) and a cationic monomer (component (b)). Alternatively, it can be obtained by the copolymerization of a styrene monomer (component (a)), a cationic monomer (component (b)), and another hydrophobic monomer (component (c)). Further alternatively, it can be obtained by the quaternization of any of these copolymers in which a vinyl monomer containing a tertiary amine group is used as component (b), by component (d).

The cationization degree of the surface sizing agent thus obtained is preferably 1.3-3.0 meq/g, more preferably 1.3-2.5 meq/g, and most preferably 1.4-2.0 meq/g. By coating a surface treating agent containing this surface sizing agent, sufficient water absorption resistance (sizing degree) can be provided to base paper. When the cationization degree is smaller than 1.3 meq/g, pulp fiber is poorly coated; when the cationization degree exceeds 3.0 meq/g, sufficient water absorption resistance cannot be provided due to the excessive hydrophilicity.

The composition of the surface sizing agent to be used in the present invention is explained as follows.

A styrene monomer of component (a) is at least one styrene monomer selected from styrene, α-methyl styrene, chlorostyrene, and cyanostyrene.

A cationic monomer of component (b) is any one of cationic vinyl monomers selected from primary amino group-containing vinyl monomers, secondary amino group-containing vinyl monomers, tertiary amino group-containing vinyl monomers, and quaternary ammonium group-containing vinyl monomers. Examples of the primary amino group-containing vinyl monomers include allylamine and methallylamine. Examples of the secondary amino group-containing vinyl monomers include diallylamine and dimethallylamine. Examples of the monomer having a tertiary amino group include vinyl compounds having a tertiary amino group and more specifically, the following compounds.

(1) (Dialkyl)aminoalkyl(meth)acrylates: e.g., dimethylaminoethyl(meth)acrylate, diethylaminoethyl(meth)acrylate, dimethylaminopropyl(meth)acrylate, and diethylaminopropyl(meth)acrylate.

(2) (Dialkyl)aminohydroxyalkyl(meth)acrylates: e.g., dimethylaminohydroxyethyl(meth)acrylate, diethylaminohydroxyethyl(meth)acrylate, dimethylaminohydroxypropyl (meth)acrylate, and diethylaminohydroxypropyl(meth) acrylate.

(3) (Dialkyl)aminoalkyl(meth)acrylamide: e.g., dimethylaminopropyl(meth)acrylamide, and dimethylaminopropyl (meth)acrylamide.

(4) Vinylpyridine (5) Vinylimidazole

An example of the monomer having a quaternary ammonium salt is a monomer which is the abovementioned monomer having a tertiary amino group quarternized by a quaternization agent. Examples of the quaternization agent to be used to obtain the monomer having a quaternary ammonium salt include epoxy compounds and organic halogen compounds, such as methyl chloride, ethyl chloride, benzyl chloride, epichlorohydrin, alkylene oxide, styrene oxide, glycidyltrimethylammonium chloride, and 3-chloro-2-hydroxylammonium chloride, dimethyl sulfate, and diethyl sulfate.

Another hydrophobic monomer of component (c) is a copolymerizable monomer and at least one hydrophobic monomer selected from methacrylic acid esters and acrylic acid esters. Examples of the methacrylic acid esters include alkyl methacrylates having 1-18 carbon atoms, such as methyl methacrylate, ethyl methacrylate, propyl methacrylate, butyl methacrylate, octyl methacrylate, and 2-ethylhexyl methacrylate; cyclohexyl methacrylates; and cyclic alkyl methacrylates such as benzyl methacrylate. Examples of the acrylic acid esters include alkyl acrylate having 1-18 carbon atoms, such as methyl acrylate, ethyl acrylate, propyl acrylate, butyl acrylate, octyl acrylate, and 2-ethylhexyl acrylate; cyclohexyl acrylates; and cyclic alkyl acrylates such as benzyl acrylate.

The quaternizing agent of component (d) is an agent to be used when a monomer having a tertiary amino group is used as component (b). The quaternizing agent is used to transform a tertiary amine in a copolymer of component (a) and component (b) or a copolymer of component (a), component (b) and component (c) into a quaternary ammonium group. Examples of this quaternizing agent include at least one quaternizing agent selected from epichlorohydrin, methyl chloride, ethyl chloride, benzyl chloride, dimethyl sulfate, diethyl sulfate, oxides, epoxy compounds and organic halogen compounds. The amount of the quaternizing agent is an amount equimolar to a cationic monomer of component (b).

In this copolymer composition, the ratio by solid weight of a styrene monomer of component (a) to a cationic monomer of component (b) is preferably in the range from 80:20 to 20:80, and more preferably from 80:20 to 50:50. When the ratio of the cationic monomer is less than 20%, the cationization degree of the copolymer becomes low and the effect of the provision of water absorption resistance is small. The higher the ratio of the cationic monomer, the higher the cationization degree of the copolymer; however, the improvement of water absorption resistance levels off at the ratio of 80% or higher. Further, within the range not to disturb water absorption resistance, a small amount of another hydrophobic monomer of component (c) can copolymerized. Component (c) can be added at most about 30 parts to 100 parts of component (a) plus component (b).

Copolymerization of component (a) and component (b) and copolymerization of component (a), component (b) and component (c) can be performed in an organic solvent in which component (a) and component (b) are soluble and in an organic solvent in which component (a), component (b) and component (c) are soluble, respectively. For example, the copolymerization can be carried out using a radical polymerization catalyst in a lower-alcohol organic solvent, such as methyl alcohol, ethyl alcohol and isopropyl alcohol, or in a petroleum-based organic solvent, such as benzene, toluene and xylene, at 60 to 130° C. for 1-10 hours; if necessary, the organic solvent is removed by distillation after completion of the polymerization. The radical polymerization catalyst is not particularly limited and can be any known in the art; for example, oil-soluble azo catalysts such as 2,2'-azobis isobutyronitrile and dimethyl 2,2'-azobis-(2-methylpropionate) and oil-soluble organic peroxides such as benzyl peroxide, tertiary-butyl peroxybenzoate and tertiary-butyl peroxy-2-ethyl hexanonate are used. Further, a chain transfer agent known in the art, such as an alkyl mercaptan, can appropriately be used together, if necessary.

A surface sizing agent is basically a copolymer of a hydrophobic monomer and a hydrophilic monomer and a macromolecular substance having surface activating properties. Accordingly, the surface sizing agent forms intramolecular micelles in an aqueous solution so that the particle diameter can be measured by the dynamic light scattering method. The surface sizing agent to be used in the present invention is water soluble; however, the average particle diameter can be measured by the dynamic light scattering method, owing to the abovementioned phenomenon, and the average particle size according to the dynamic light scattering method is 40 nm or smaller. The sizing effects are great because the high fiber coating ratio per unit weight is high when the average particle size is small, whereas the sizing effects become insufficient when the average particle size is larger than this.

Detailed mechanisms of providing water absorption resistance by this copolymer composition are not known; however, the present inventors presume as follows. The presumption is that the cationic monomer part in the molecule of surface sizing agent aligns inside the paper surface due to the interaction with a carboxyl group of pulp while the hydrophobic group part of an ethylene monomer in the molecule of surface sizing agent aligns outside the paper surface, resulting in an increase in the droplet water absorption degree, that is, an index for water absorption resistance.

In the same manner as in a general method for manufacturing newsprint, this surface sizing agent is mixed with a water-soluble macromolecular substance, a binder, to make it into a surface treating agent, and then coated onto newsprint base paper. Examples of the water-soluble macromolecular substance include starches such as starch, enzymatically modified starches, thermochemically modified starches, oxidized starches, esterified starches, etherificated starches (e.g., hydroxyethylated starch) and cationized starches; polyvinyl alcohols such as polyvinyl alcohol, completely saponificated polyvinyl alcohol, partially saponificated polyvinyl alcohol, carboxyl-modified polyvinyl alcohol, silanol-modified polyvinyl alcohol, cationic modified polyvinyl alcohol and terminal alkyl-modified polyvinyl alcohol; polyacrylamides such as polyacrylamide, cationic polyacrylamide, anionic polyacrylamide and amphoteric polyacrylamide; and cellulose derivatives such as carboxymethyl cellulose, hydroxyethyl cellulose and methyl cellulose. They can be used alone or in combination of two or more. Use of these water-soluble macromolecular substances is important to increase the surface strength of newsprint and to suppress the generation of paper powder upon printing.

The amount of the water-soluble macromolecular substance is determined by the target value of the surface strength of newsprint; the amount of the cationic styrene sizing agent to be used in the present invention is mainly determined by the target value of water absorption resistance of newsprint. From this respect, the mixing ratio of the water-soluble macromolecular substance to the surface sizing agent is not particularly limited. However, generally, 1-50 parts by weight, preferably 15-40 parts by weight, and more preferably 20-40 parts by weight of the cationic styrene sizing agent in the present invention can be used relative to 100 parts by weight of the water-soluble macromolecular substance.

The surface treating agent to be used in the present invention can contain auxiliary agents such as Neppari preventing agents, preservatives, anti-foaming agents, slipping agents, anti-slipping agents, UV-preventing agents, discoloration preventing agents, fluorescent brighteners, and viscosity stabilizers, and other surface sizing agents (e.g., styrene/acrylic acid copolymers, styrene/maleic acid copolymers, and olefin copolymers), within the range not to adversely affect water absorption resistance that is the effectiveness of the present invention.

Base paper for newsprint to be used in the present invention is manufactured by a papermaking machine known in the art and publicly used using mechanical pulp (MP) such as grougwood pulp (GP), thermomechanical pulp (TMP), chemithermomechanical pulp (CTMP) and semichemical pulp (SCP), and chemical pulp (CP) represented by kraft pulp (KP) and sulphite pulp (SP), and further, deinked pulp (DIP) obtained by deinking used paper containing the abovementioned pulp and recycled pulp obtained by disaggregating waste paper generated from papermaking process, alone or in mixture in any ratio. The mixing ratio of DIP is preferably in the range of 60-100% by weight, considering the requirement for the increased DIP ratio due to today's growing interest in environmental protection.

The base paper for newsprint of the present invention may contain, if necessary, fillers such as white carbon, clay, silica, talc, titanium oxide, calcium carbonate, and synthetic resin fillers (e.g., vinyl chloride resins, polystyrene resins, urea/formalin resins, melamine resins, styrene/butadiene copolymer resins). Furthermore, the base paper may contain paper strength reinforcing agents for internal addition such as polyacrylamide polymers, polyvinyl alcohol polymers, cationic starches, urea/formalin resins, and melamine/formalin resins; freeness and/or yield improving agents such as salts of acrylamide/aminomethylacrylamide copolymers, cationic starches, polyethyleneimine, polyethylene oxide, and acrylamide/sodium acrylate copolymers; sizing agents for internal addition such as rosin sizing agents, AKD, ASA, petroleum sizing agents, and neutral rosin sizing agents; and auxiliary agents such as UV-preventing agents and discoloration preventing agents.

The abovementioned base paper for newsprint can be coated with the surface-treating agent of the present invention using an ordinary coating device for paper manufacturing. For example, a two-roll size press, blade-metering size press, rod-metering size press, gate roll coater, bar coater, air knife coater, and spray coating machine can be used. Among these devices, film-transferring type coaters represented by a gate roll coater are preferred; the gate roll coater (GRC) is commonly used in the case of newsprint and is most preferably used also in the present invention.

The speed of coating with the surface treating agent of the present invention is not particularly limited and can be about the same speed as used in an ordinary papermaking machine for newsprint, generally in the range of 800-2500 m/minute. When coated at a speed higher than 800 m/minute, paper dries before the surface treating agent sufficiently infiltrates into the paper layer, so that more of the surface treating agent remains in the proximity of the surface layer, more effectively suppressing the swelling of the fiber present in the paper surface layer upon water absorption.

The amount of coating of the surface treating agent used in the present invention is not particularly limited and can be determined depending on the quality of newsprint for offset printing; however, the appropriate amount of coating is in the range of 0.05-2.0 g/m$^2$ (on both sides). When the amount of coating is smaller than 0.05 g/m$^2$, the surface strength of the newsprint may be insufficient. On the other hand, the amount of coating greater than 2.0 g/m$^2$ may increasingly cause Neppari that is a problem unique to newsprint for offset printing (an adhesive trouble caused by transferring and accumulating coating materials onto a blanket upon printing a large amount of newsprint).

After coating and drying of the surface treating agent, the newsprint of the present invention is preferably treated by a calender to attain the paper thickness and smoothness suitable for offset printing. Examples of the calender include an ordinary hard-nip calender and a hot soft-nip calender (summarized, for example, in Japanese Journal of Paper technology (Kami Parupu Gijutsu Taimusu) Vol. 43, No. 1 (2000), p. 23). Considering the transition to lighter-weight newsprint in future, the soft-nip calender is more preferably used for newsprint of the present invention. In terms of color printability, the surface treating agent of the present invention can be appropriately used in combination with the soft-nip calendering.

The present invention is explained by referring the following examples, which is naturally not intended to limit the scope of the invention. Further, unless otherwise mentioned, parts and % in the examples are parts by solid weight and % by solid weight, respectively.

<Manufacturing of Newsprint Base Paper>

Base paper A: A mixture of 50 parts of DIP, 30 parts of TMP, 10 parts of KP and 10 parts of GP was macerated and the resulting pulp slurry was prepared to have a freeness of 190 ml, to which were added calcium carbonate at 2.5% by weight of oven-dried pulp as a filler and aluminum sulfate (a 50% by weight $Al_2O_3.14H_2O$ product) at 1.5%, after which neutral papermaking was performed using a Bel-Baie former type paper machine to obtain newsprint base paper having a basis weight of 42 g/m$^2$, without internal sizing and calendering. The base paper has a droplet water absorption degree of 3 seconds.

Base paper B: A mixture of 50 parts of DIP, 30 parts of TMP, 10 parts of KP and 10 parts of GP was macerated and the resulting pulp slurry was prepared to have a freeness of 190 ml, to which were added talc at 1.5% by weight of oven-dried pulp as a filler and aluminum sulfate (a 50% by weight $Al_2O_3.14H_2O$ product) at 2.0%, after which acidic papermaking was performed using a Bel-Baie former type paper machine to obtain newsprint base paper having a basis weight of 42 g/m$^2$, without internal sizing and calendering. The base paper has a droplet water absorption degree of 5 seconds.

Base paper C: A mixture of 50 parts of DIP, 30 parts of TMP, 10 parts of KP and 10 parts of GP was macerated and the resulting pulp slurry was prepared to have a freeness of 190 ml, to which were added talc at 1.5% by weight of oven-dried pulp as a filler and aluminum sulfate (a 50% by weight $Al_2O_3.14H_2O$ product) at 3.5%, after which acidic papermaking was performed using a Bel-Baie former type paper machine to obtain newsprint base paper having a weight of 42 g/m$^2$, without internal sizing and calendering. The base paper has a droplet water absorption degree of 4 seconds.

<Monomers and Other Materials for Surface Sizing Agent>

Surface sizing agents to be used in examples and comparative examples were manufactured by the copolymerization using materials each selected from the following monomers and quaternizing agents.

Component (a): Styrene Monomers
a-1: Styrene

Component (b): Cationic Monomers
b-1: Dimethylaminoethyl methacrylate
b-2: Dimethylaminoethyl benzylchloride methacrylate Component (c): Other Hydrophobic Monomers
c-1: Methyl methacrylate
c-2: Isobutyl methacrylate Component (d): Quaternizing Agents
d-1: Epichlorohydrin The styrene monomer/cationic monomer ratio by solid weight is naturally in the range of 80/20 to 20/80.

<Cationization Degree and Average Particle Diameter of Surface Sizing Agent, and Methods for Paper Quality Measurement>

(1) Cationization degree: Determined by the titration with 1/1000 N potassium polyvinylsulfonate (PVSK) using a Mutech Particle Charge Detector 03, setting the point where the streaming current is zero as the endpoint.

(2) Average particle diameter: Measured by the dynamic light scattering method using a Zetasizer 300HSa (Malvern).

(3) Droplet water absorption degree: Measured according to Japan JAPPI No. 33 (a method for testing water absorption speed of absorptive paper) at a droplet water volume of 1 μl. The droplet water absorption degree is an index for water absorption resistance.

<Manufacturing of Newsprint>

Example 1

Component (a-1) and component (b-1) were copolymerized at a mixing ratio by solid weight of 80:20 in an organic solvent and quaternized using component (d-1) in an amount equimolar to component (b-1). Next, the organic solvent was removed by distillation to obtain a water-soluble surface sizing agent. This surface sizing agent was mixed with a 6.0% solution of hydroxyethylated starch (Ethylex-2025, Staley) at a ratio to starch of 20% to prepare a surface treating agent. The newsprint base paper A was coated with the surface treating agent thus prepared using a gate role coater (at a coating speed of 1200 m/minute on both sides). The amount of the coating was 0.50 g/m$^2$ on both sides. The resulting paper was subjected to a hard-nip calender treatment to obtain newsprint for offset printing. The results are shown in Table 1.

Example 2

Component (a-1) and component (b-1) were copolymerized at a mixing ratio by solid weight of 80:20 in an organic solvent. Next, the organic solvent was removed by distillation to obtain a water-soluble surface sizing agent. This surface sizing agent was mixed with a 6.0% solution of hydroxyethylated starch (Ethylex-2025, Staley) at a ratio to starch of 20% to prepare a surface treating agent. The newsprint base paper A was coated with the surface treating agent thus prepared using a gate role coater (at a coating speed of 1200 m/minute on both sides). The amount of the coating was 0.50 g/m$^2$ on both sides. The resulting paper was subjected to a hard-nip calender treatment to obtain newsprint for offset printing. The results are shown in Table 1.

Example 3

Component (a-1), component (b-1) and component (c-1) were copolymerized at a mixing ratio by solid weight of 60:30:10. Next, the organic solvent was removed by distillation to obtain a water-soluble surface sizing agent. This surface sizing agent was mixed with a 6.0% solution of hydroxyethylated starch (Ethylex-2025, Staley) at a ratio to starch of 20% to prepare a surface treating agent. The newsprint base paper A was coated with the surface treating agent thus prepared using a gate role coater (at a coating speed of 1200 m/minute on both sides). The amount of the coating was 0.49 g/m$^2$ on both sides. The resulting paper was subjected to a hard-nip calender treatment to obtain newsprint for offset printing. The results are shown in Table 1.

Example 4

Component (a-1), component (b-1) and component (c-1) were copolymerized at a mixing ratio by solid weight of 60:30:10, after which component (d-1) in an amount equimolar to component (b-1) was added for quaternization. Next, the organic solvent was removed by distillation to obtain a water-soluble surface sizing agent. This surface sizing agent was mixed with a 6.0% solution of hydroxyethylated starch (Ethylex-2025, Staley) at a ratio to starch of 20% to prepare a surface treating agent. The newsprint base paper A was coated with the surface treating agent thus prepared using a gate role coater (at a coating speed of 1200 m/minute on both sides). The amount of the coating was 0.48 g/m$^2$ on both sides. The resulting paper was subjected to a hard-nip calender treatment to obtain newsprint for offset printing. The results are shown in Table 1.

Example 5

Component (a-1), component (b-1) and component (c-1) were copolymerized at a mixing ratio by solid weight of 60:30:10, after which component (d-1) in an amount equimolar to component (b-1) was added for quaternization. Next, the organic solvent was removed by distillation to obtain a water-soluble surface sizing agent. This surface sizing agent was mixed with a 6.0% solution of hydroxyethylated starch (Ethylex-2025, Staley) at a ratio to starch of 20% to prepare a surface treating agent. The newsprint base paper B was coated with the surface treating agent thus prepared using a gate role coater (at a coating speed of 1200 m/minute on both sides). The amount of the coating was 0.48 g/m$^2$ on both sides. The resulting paper was subjected to a hard-nip calender treatment to obtain newsprint for offset printing. The results are shown in Table 1.

COMPARATIVE EXAMPLE 1

Component (a-1) and component (b-1) were copolymerized at a mixing ratio by solid weight of 95:5. Next, the organic solvent was removed by distillation to obtain a water-soluble surface sizing agent. This surface sizing agent was mixed with a 6.0% solution of hydroxyethylated starch (Ethylex-2025, Staley) at a ratio to starch of 20% to prepare a surface treating agent. The newsprint base paper A was coated with the surface treating agent thus prepared using a gate role coater (at a coating speed of 1200 m/minute on both sides).

The amount of the coating was 0.55 g/m$^2$ on both sides. The resulting paper was subjected to a hard-nip calender treatment to obtain newsprint for offset printing. The results are shown in Table 1.

COMPARATIVE EXAMPLE 2

Component (a-1), component (b-1) and component (c-2) were copolymerized at a mixing ratio by solid weight of 85:5:10. Next, the organic solvent was removed by distillation to obtain a water-soluble surface sizing agent. This surface sizing agent was mixed with a 6.0% solution of hydroxyethylated starch (Ethylex-2025, Staley) at a ratio to starch of 20% to prepare a surface treating agent. The newsprint base paper A was coated with the surface treating agent thus prepared using a gate role coater (at a coating speed of 1200 m/minute on both sides). The amount of the coating was 0.50 g/m$^2$ on both sides. The resulting paper was subjected to a hard-nip calender treatment to obtain newsprint for offset printing. The results are shown in Table 1.

COMPARATIVE EXAMPLE 3

Component (a-1) and component (b-1) were subjected to emulsion polymerization at a mixing ratio by solid weight of 80:20 in an aqueous medium and quaternized using component (d-1) in an amount equimolar to component (b-1) to obtain a surface sizing agent as an emulsion in water. This surface sizing agent was mixed with a 6.0% solution of hydroxyethylated starch (Ethylex-2025, Staley) at a ratio to starch of 20% to prepare a surface treating agent. The newsprint base paper A was coated with the surface treating agent thus prepared using a gate role coater (at a coating speed of 1200 m/minute on both sides). The amount of the coating was 0.52 g/m$^2$ on both sides. The resulting paper was subjected to a hard-nip calender treatment to obtain newsprint for offset printing. The results are shown in Table 1.

COMPARATIVE EXAMPLE 4

Component (a-1) and component (b-1) were subjected to emulsion polymerization at a mixing ratio by solid weight of 80:20 in an aqueous medium to obtain a surface sizing agent as an emulsion in water. This surface sizing agent was mixed with a 6.0% solution of hydroxyethylated starch (Ethylex-2025, Staley) at a ratio to starch of 20% to prepare a surface treating agent. The newsprint base paper A was coated with the surface treating agent thus prepared using a gate role coater (at a coating speed of 1200 m/minute on both sides). The amount of the coating was 0.48 g/m$^2$ on both sides. The resulting paper was subjected to a hard-nip calender treatment to obtain newsprint for offset printing. The results are shown in Table 1.

COMPARATIVE EXAMPLE 5

Component (a-1) and component (b-2) were subjected to emulsion polymerization at a mixing ratio by solid weight of 80:20 in an aqueous medium to obtain a surface sizing agent as an emulsion in water. This surface sizing agent was mixed with a 6.0% solution of hydroxyethylated starch (Ethylex-2025, Staley) at a ratio to starch of 20% to prepare a surface treating agent. The newsprint base paper A was coated with the surface treating agent thus prepared using a gate role coater (at a coating speed of 1200 m/minute on both sides). The amount of the coating was 0.49 g/m$^2$ on both sides. The resulting paper was subjected to a hard-nip calender treatment to obtain newsprint for offset printing. The results are shown in Table 1.

COMPARATIVE EXAMPLE 6

An anionic styrene surface sizing agent KN-520 (Harima Chemicals Inc.) generally used for acidic newsprint was used as a surface sizing agent. This surface sizing agent was mixed with a 6.0% solution of hydroxyethylated starch (Ethylex-2025, Staley) at a ratio to starch of 20% to prepare a surface treating agent. The newsprint base paper A was coated with the surface treating agent thus prepared using a gate role coater (at a coating speed of 1200 m/minute on both sides). The amount of the coating was 0.48 g/m$^2$ on both sides. The resulting paper was subjected to a hard-nip calender treatment to obtain newsprint for offset printing. The results are shown in Table 1.

COMPARATIVE EXAMPLE 7

Component (a-1), component (b-1) and component (c-1) were copolymerized at a mixing ratio by solid weight of 60:30:10 and then quaternized by adding component (d-1) in an amount equimolar to component (b-1). Next, the organic solvent was removed by distillation to obtain a water-soluble surface sizing agent. This surface sizing agent was mixed with a 6.0% solution of hydroxyethylated starch (Ethylex-2025, Staley) at a ratio to starch of 20% to prepare a surface treating agent. The newsprint base paper C was coated with the surface treating agent thus prepared using a gate role coater (at a coating speed of 1200 m/minute on both sides). The amount of the coating was 0.49 g/m$^2$ on both sides. The resulting paper was subjected to a hard-nip calender treatment to obtain newsprint for offset printing. The results are shown in Table 1.

TABLE 1

| | Surface sizing agent preparing conditions Mixing ratio | | | | Surface sizing agent | | | Treating agent, | Droplet |
|---|---|---|---|---|---|---|---|---|---|
| | | | | | Cationization degree | Average particle diameter | Base | amount of coating | water absorption degree |
| | a | b | c | d | meq/g | nm | paper | (g/m$^2$) | (seconds) |
| Example | | | | | | | | | |
| 1 | 80 | 20 | | Equimolar to (b) | 1.3 | 46 | A | 0.50 | 30 |
| 2 | 80 | 20 | | | 1.3 | 43 | A | 0.50 | 35 |
| 3 | 60 | 30 | 10 | | 1.5 | 33 | A | 0.49 | 60 |

TABLE 1-continued

| | Surface sizing agent preparing conditions Mixing ratio | | | | Surface sizing agent | | | Treating agent, | Droplet |
|---|---|---|---|---|---|---|---|---|---|
| | | | | | Cationization degree | Average particle diameter | Base | amount of coating | water absorption degree |
| | a | b | c | d | meq/g | nm | paper | (g/m$^2$) | (seconds) |
| 4 | 60 | 30 | 10 | Equimolar to (b) | 1.7 | 32 | A | 0.48 | 103 |
| 5 | 60 | 30 | 10 | Equimolar to (b) | 1.7 | 32 | B | 0.48 | 95 |
| Comparative Example | | | | | | | | | |
| 1 | 95 | 5 | | | 0.5 | 130 | A | 0.55 | 11 |
| 2 | 85 | 5 | 10 | | 0.5 | 152 | A | 0.50 | 10 |
| 3 | 80 | 20 | | Equimolar to (b) | 1.1 | 184 | A | 0.52 | 9 |
| 4 | 80 | 20 | | | 1.0 | 175 | A | 0.48 | 9 |
| 5 | 80 | 20 | | | 1.0 | 173 | A | 0.49 | 7 |
| 6 | | | | | −1.2 | 20 | A | 0.48 | 9 |
| 7 | 60 | 30 | 10 | Equimolar to (b) | 1.7 | 32 | C | 0.49 | 15 |

INDUSTRIAL APPLICABILITY

Newsprint of the present invention has excellent water absorption resistance so that swelling or elongation of fibers caused by the absorption of the dumping water upon offset printing can be suppressed and thus a clear printing image without color registration errors can be attained.

The invention claimed is:

1. Newsprint for offset printing, characterized in that said newsprint for offset printing is obtained by a process in which base paper for newsprint is coated with a surface treating agent mainly comprised of the following component (A) and component (B), dried and subjected to a calender treatment:

component (A): at least one water-soluble macromolecular substance selected from the group consisting of starches, polyvinyl alcohols, polyacrylamides, and cellulose derivatives;

component (B): a water-soluble surface sizing agent that is a copolymer obtained by the copolymerization of the following component (a) and component (b); a copolymer obtained by the copolymerization of component (a), component (b) and component (c); or a copolymer obtained by quaternizing, by component (d), any of the foregoing copolymers in which component (b) is a vinyl monomer containing a tertiary amine group;

component (a): styrene monomer which is at least one styrene monomer selected from the group consisting of styrene, α-methyl styrene, chlorostyrene and cyanostyrene, component (b): cationic monomer which is a vinyl monomer containing any one of primary amino group, secondary amino group, and tertiary amino group, component (c): other hydrophobic monomers which is at least one hydrophobic monomer which is copolymerizable and selected from the group consisting of methacrylic acid esters and acrylic acid esters, component (d): quaternizing agents which is at least one quaternizing agent selected from the group consisting of epichlorohydrin, methyl chloride, ethyl chloride, benzyl chloride, dimethyl sulfate, diethyl sulfate, oxides, epoxy compounds, and organic halogen compounds, wherein the cationization degree of the water-soluble surface sizing agent is 1.4-2.0 meq/g, the average particle size of the water-soluble surface sizing agent is 40 nm or smaller, aluminum sulfate (a 50% by weight $Al_2O_3.14H_2O$ product) is added to the papermaking pulp at a ratio of less than 3.0% by weight relative to oven-dried pulp when manufacturing the base paper for newsprint, and a ratio by solid weight of the styrene monomer of component (a) to the cationic monomer of component (b) is in the range from 80:20 to 20:80.

2. The newsprint for offset printing according to claim 1, wherein the base paper has a basis weight of 33-45 g/m$^2$.

3. The newsprint for offset printing according to claim 1, wherein the ratio by solid weight of the styrene monomer of component (a) to the cationic monomer of component (b) is in the range from 80:20 to 50:50.

4. A newsprint for offset printing comprising:

a base paper for newsprint; and a coating of a surface treating agent with which the base paper is coated, said surface treating agent being comprised of components (A) and (B) as a main constituent and dried, wherein component (A) is at least one water-soluble macromolecular substance selected from the group consisting of starches, polyvinyl alcohols, polyacrylamides, and cellulose derivatives;

component (B) is a water-soluble surface sizing agent selected from the group consisting of a copolymer obtained by copolymerization of components (a) and (b); a copolymer obtained by copolymerization of components (a), (b), and (c); or a copolymer obtained by quaternizing, by component (d), any of the foregoing copolymers in which component (b) is a vinyl monomer containing a tertiary amine group;

component (a) is a styrene monomer which is at least one styrene monomer selected from the group consisting of styrene, α-methyl styrene, chlorostyrene and cyanostyrene;

component (b) is a cationic monomer which is a vinyl monomer containing any one of primary amino group, secondary amino group, or tertiary amino group, component (c) is at least one hydrophobic monomer, other than components (a) or (b), which is copolymerizable and selected from the group consisting of methacrylic acid esters and acrylic acid esters, and component (d) is at least one quaternizing agent selected from the group consisting of epichlorohydrin, methyl chloride, ethyl chloride, benzyl chloride, dimethyl sulfate, diethyl sulfate, oxides, epoxy compounds, and organic halogen compounds, wherein the water-soluble surface sizing agent has a cationization degree of 1.4-2.0 meq/g, the water-soluble surface sizing agent has an average particle size of 40 nm or smaller, the base paper contains aluminum sulfate added thereto at a ratio of less than 3.0% by weight relative to oven-dried pulp of the base paper, and a ratio by solid weight of the styrene monomer of component (a) to the cationic monomer of component (b) is in the range from 80:20 to 20:80.

5. The newsprint for offset printing according to claim 4, wherein the aluminum sulfate is a 50% by weight $Al_2O_3.14H_2O$ product.

6. The newsprint for offset printing according to claim 4, wherein the base paper is a neutral papermaking processed paper.

7. The newsprint for offset printing according to claim 4, wherein the base paper is coated with the coating at 0.05-2.0 $g/m^2$ on both sides.

8. The newsprint for offset printing according to claim 4, wherein component (c) is added at no more than 30 parts relative to 100 parts of component (a) and component (b).

9. The newsprint for offset printing according to claim 4, wherein a ratio of components (B) to (A) is 1/100 to 50/100 by weight before being dried.

10. The newsprint for offset printing according to claim 4, wherein the base paper has a basis weight of 33-45 $g/m^2$.

11. The newsprint for offset printing according to claim 4, wherein the ratio by solid weight of the styrene monomer of component (a) to the cationic monomer of component (b) is in the range from 80:20 to 50:50.

* * * * *

UNITED STATES PATENT AND TRADEMARK OFFICE

CERTIFICATE OF CORRECTION

PATENT NO. : 7,691,231 B2
APPLICATION NO. : 10/563621
DATED : April 6, 2010
INVENTOR(S) : Hiroshi Ono et al.

It is certified that error appears in the above-identified patent and that said Letters Patent is hereby corrected as shown below:

On the title page, Item (57) Abstract, Line 12; Change "cat ionic" to --cationic--.

Column 3, lines 12-13; Change "resistance," to --resistance;--.

Column 4, line 42; Change "10-259592" to --10-259591--.

Column 4, line 52; Before "Japanese" delete "patent".

Column 7, line 13; Change "quarternized" to --quaternized--.

Column 8, line 14; Change "hexanonate" to --hexanoate--.

Column 9, lines 21-22; Change "grougwood" to --groundwood--.

Signed and Sealed this

Ninth Day of November, 2010

David J. Kappos

David J. Kappos
*Director of the United States Patent and Trademark Office*